US006286719B1

(12) United States Patent
Haines

(10) Patent No.: US 6,286,719 B1
(45) Date of Patent: Sep. 11, 2001

(54) ILLUMINATED BEVERAGE CONTAINER

(76) Inventor: Troy Lee Haines, 1525 W. Ardmore Ave., Itasca, IL (US) 60143

( * ) Notice: Subject to any disclaimer, the term of this patent is extended or adjusted under 35 U.S.C. 154(b) by 0 days.

(21) Appl. No.: 09/502,638

(22) Filed: Feb. 11, 2000

(51) Int. Cl.[7] ..... B65D 5/66
(52) U.S. Cl. ..... 222/113; 362/101; 222/185.1
(58) Field of Search ..... 222/192, 184, 222/185.1, 113; 362/101, 96, 156

(56) References Cited

U.S. PATENT DOCUMENTS

D. 389,002 * 1/1998 Demore et al. ..... D7/313
2,562,212 * 7/1951 Rogers et al. ..... 222/181
4,344,113 * 8/1982 Ditto et al. ..... 362/101
4,836,476 * 6/1989 Wolf ..... 248/146
6,065,848 * 5/2000 Tucker et al. ..... 362/101

* cited by examiner

*Primary Examiner*—Kevin Shaver
*Assistant Examiner*—M A Cartagena
(74) *Attorney, Agent, or Firm*—John D. Gugliotta; Michael J. Corrigan

(57) ABSTRACT

An apparatus is provided that combines the functions of a battery powered light and a water or beverage dispenser into one item. A large liquid container is located on the top and has a removable lid for cleaning and filling. A handle, suitable for hanging, is provided at the top of the container as well. A pouring spout is located on the circumference of the container toward the lower edge and functions in the customary manner. A base is provided for the container which houses a fluorescent or incandescent lamp, batteries, a switch and associated electrical components to allow the lamp to illuminate. The lamp is located such that it provides light directly into the liquid container.

8 Claims, 4 Drawing Sheets

ILLUMINATED BEVERAGE CONTAINER

RELATED APPLICATIONS

The present invention was first described in Disclosure Document Number 463,270 filed on Oct. 25, 1999. There are no previously filed, nor currently any co-pending applications, anywhere in the world.

BACKGROUND OF THE INVENTION

1. Field of the Invention

The present invention relates generally to beverage containers and, more particularly, to a beverage container having a light in the base.

2. Description of the Related Art

Camping, hunting, fishing and other outdoor activities are enjoyed by many. A common item that is used during all of these activities, especially those that happen during night time hours, is a battery powered light such as a flashlight or lantern. Another common item is a disposable plastic container for holding water or other liquid that serves as a refreshing beverage. Such disposable plastic containers are commonly sold at grocery stores in the 2.5 gallon size. While these items are separate, they are often used together as would be the case when getting a drink during evening or nighttime hours. This feat often requires the balancing of a flashlight while pouring a drink, which often results in spills and messes. Additionally, both of these items require space and/or weight allowances which are often at a premium during camping activities.

Accordingly, there exists a need for a means by which the functions of a water or beverage container can be combined with that of a battery powered light to produce an item that not only combines the functions of the two but also produces a soothing viewing experience.

In the related art, there exists patents for various beverage dispensing device having an integral light for indicating some information related to the beverage dispensing process. The art is completely devoid of any patents which shine light into a beverage for display and illumination purposes. Nor were there any patents which have a combination beverage dispenser and light with a removable light.

A search of the prior art did not disclose any patents that read directly on the claims of the instant invention; however, the following references were considered related:

| U.S. Pat. No. | Inventor | Issue Date |
|---|---|---|
| 5,540,355 | Hancock et al. | Jul. 30, 1996 |
| 4,544,084 | Cleland | Oct. 1, 1985 |
| 5,967,371 | Stephen | Oct. 19, 1999 |
| 5,918,768 | Ford | Jul. 6, 1999 |
| 5,913,454 | McHale | Jun. 22, 1999 |
| 5,586,691 | Gotch et al. | Dec. 24, 1996 |
| 4,673,108 | de Man | Jun.16, 1987 |
| 4,426,021 | Rosenthal | Jan. 17, 1984 |
| 4,254,452 | Switala | Mar. 3, 1981 |
| 2,631,393 | Hetherington | Mar. 17, 1953 |

Consequently, a need has been felt for providing an apparatus which combines the functions of a beverage container and a light into a single unit.

SUMMARY OF THE INVENTION

It is therefore an object of the present invention to provide a device which performs the functions of both a water container and an illumination device.

It is another object of the present invention to save space and weight while packing and/or camping.

It is yet another object of the present invention to provide pleasing mood lighting, even at home.

It is yet still another object of the present invention to ensure a source of fresh water is always at hand.

It is still yet another object of the present invention that water and light are easily accessible in emergency situations such as power outages, floods, and automobile emergencies.

It is an advantage of the present invention that it can be used to carry just about any liquid refreshment.

It is another advantage of the present invention that it is easy to fill and clean.

It is yet another advantage of the present invention that the fluorescent/incandescent light uses low power.

It is yet still another advantage of the present invention that it is battery operated, can be used anywhere, and does not rely on external sources of power.

It is a feature of the present invention that it can be placed upon virtually any flat surface.

It is another feature of the present invention that it will operate for an extended time on one set of batteries.

It is yet another feature of the present invention that it is controlled by an integral on/off switch.

It is yet still another feature of the present invention that the light illuminating the container is pulled out of the base for use as a spotting/flash light.

It is a benefit of the present invention that the beverage container produces less glare.

It is another benefit of the present invention that it is cool to operate and touch.

Briefly described according to the preferred embodiment of the present, an apparatus is provided that combines the functions of a battery powered light and a water or beverage dispenser into one item. A large liquid container is located on the top of the invention. The container has a removable lid for cleaning and filling. The container is the same size and shape as the disposable, rectangular plastic container of the 2.5 gallon size wherein water is usually sold in grocery stores. In this fashion, water containers from the grocery stores can be alternately used in place of the provided beverage container. A pouring spout is located on the circumference of the container toward the lower edge and functions in the customary manner to dispense the beverage. A base is provided for the container which has a cavity for housing a fluorescent/incandescent lamp having batteries and a switch, and associated electrical components to allow the lamp to illuminate and spot. The base has an opening formed in the top and a lens embedded to allow light from the fluorescent/incandescent lamp to provide light directly into the liquid container.

The opaque plastic that is used for the liquid container allows the light to disperse throughout the container and give the appearance that the light is emanating from within the liquid itself.

The use of the present invention allows one device to serve the multiple functions of liquid dispensing and providing illumination in a manner that is fun and exciting.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

LIST OF REFERENCE NUMBERS

| | |
|---|---|
| 10 | Illuminated Beverage Container |
| 15 | Beverage Storage Volume |
| 20 | Base |
| 21 | Lamp Cavity |
| 21a | Latch Receiving Point |
| 22 | Light Aperture |
| 23 | Drawer Aperture |
| 24 | Strap Receiving Notches |
| 25 | Lens |
| 26 | Drawer |
| 27 | Straps |
| 27a | Clamp |
| 30 | Fluorescent/Incandescent Lamp |
| 31 | Latching Means |
| 32 | Handle |
| 33 | On/Off Switch |
| 34 | Bulb |
| 35 | Battery Compartment |

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
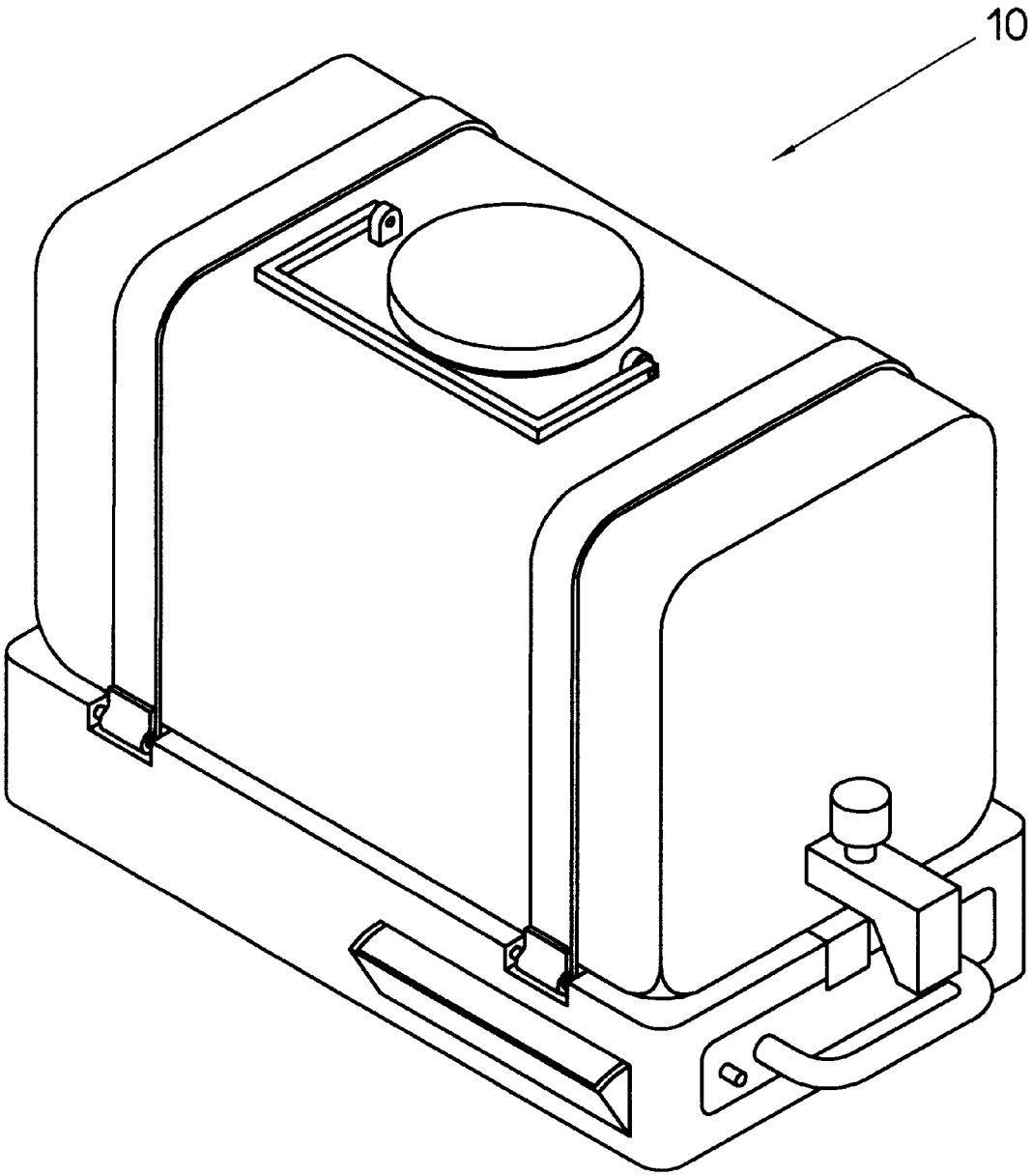
FIG. 1 is a side perspective view of an illuminated beverage container, according to the preferred embodiment of the present invention.

Referring now to FIG. 1, an illuminated beverage container 10 is shown, according to the present invention, for use when camping or at other times where it is desired to be able to see and serve a beverage. It is particularly useful when camping because it eliminates the need to have additional lighting.

Essentially, the illuminated beverage container 10 consists of a beverage storage volume 15 strapped to a specially formed base 20 adapted to receive container 15. Base 20 is essentially a rectangular shaped vessel having an interior volume and made from injection molded plastic. Container 15 is essentially a rectangular shaped injection molded plastic vessel having an interior volume of 2.5 gallons. The volume and dimensions chosen match the 2.5 gallon disposable plastic containers wherein water and other beverages are commonly sold in grocery stores and the like. In this manner, the provided 2.5 gallon container 15 can be temporarily substituted for a disposable container from the grocery store. A tap or pouring spout is provided on container 15 to allow a user to dispense fluids from the container. A fluorescent/incandescent lamp is removably installed in a cavity in base 20 and pointed upward so that light from the lamp is directed up into the beverage storage volume 15.

Figure 2:
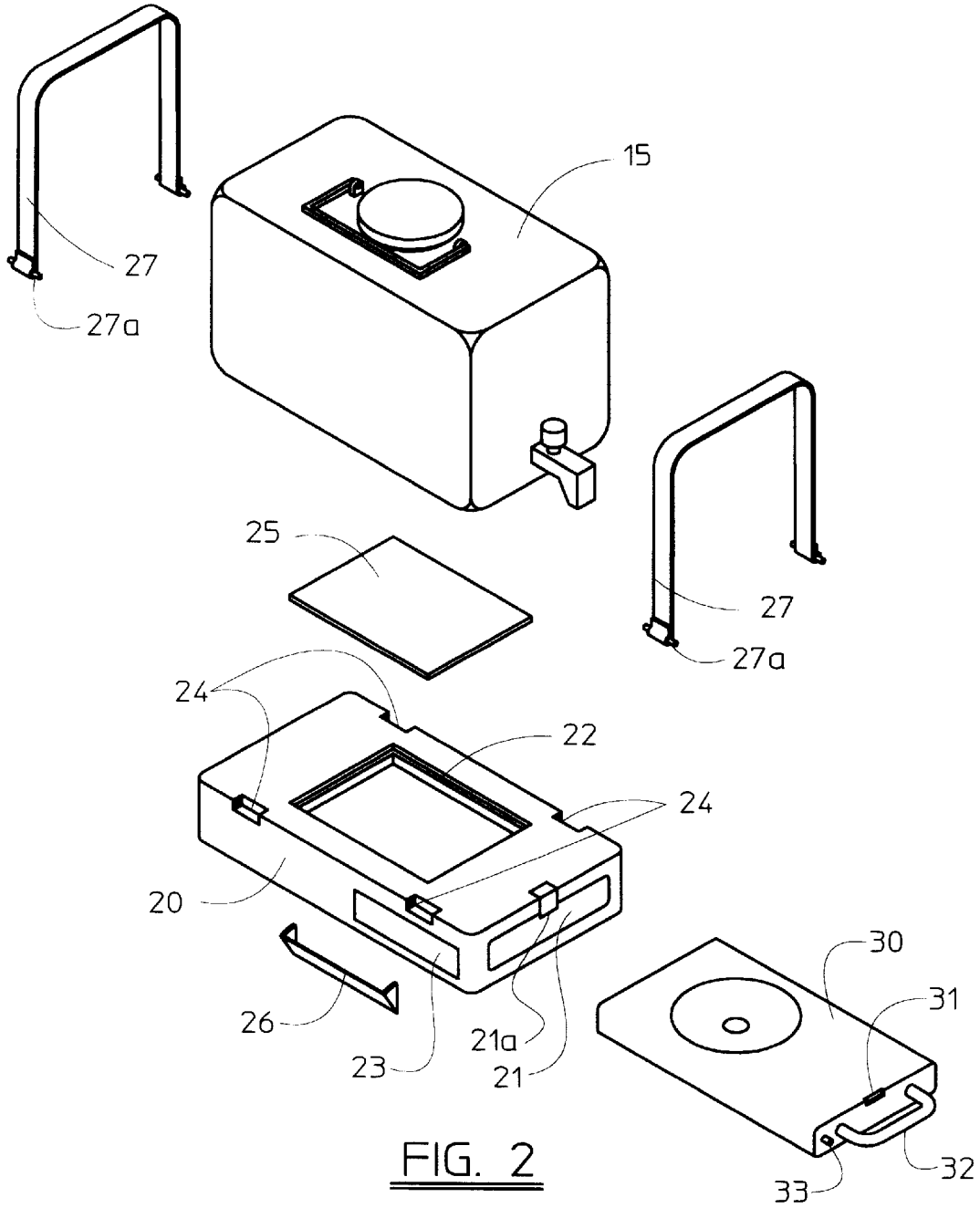
FIG. 2 is an exploded side perspective view thereof.
Figure 3:
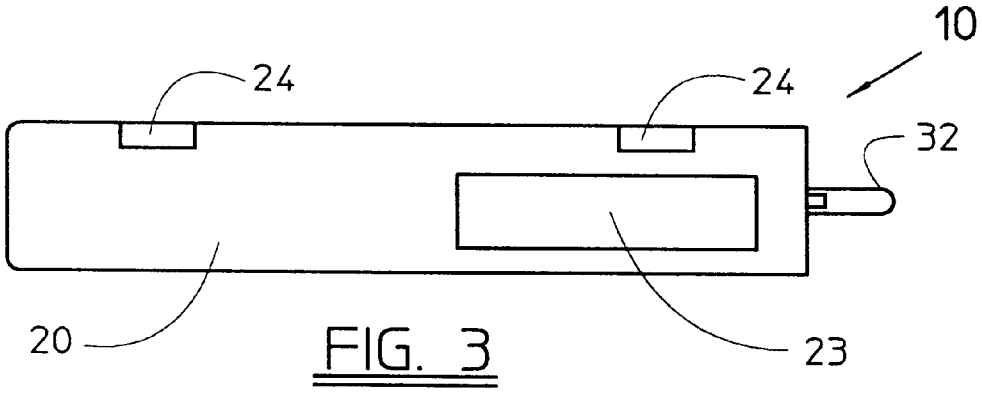
FIG. 3 is a side view of the base for use therewith.

FIG. 2 shows this construction in more detail. A pair of nylon straps 27 removably secure container 15 to base 20. A clamp 27*a* at each end of strap 27 is designed to be clamped to a strap receiving point 24 formed in the upper edges of base 20. A rectangular aperture 22 is formed in the upper surface of base 20 for allowing light from fluorescent/incandescent lamp 30 below to shine into the bottom of container 15. A transparent lens 25 is permanently attached to cover aperture 22 to make the interior of base 20 segregated from the bottom of container 15 but yet allows light to pass through from fluorescent/incandescent lamp 30 to container 15. Fluorescent/incandescent lamp 30 is inserted into a specially formed cavity 21 in one of the ends of base 20. A latch means such as latch 31 secures fluorescent/incandescent lamp 30 to base 20 via a notch 21*a* formed on base 20. An on/off switch 33 on the front of fluorescent/incandescent lamp 30 allows the user to turn fluorescent/incandescent lamp 30 on and off as desired. Fluorescent/incandescent lamp 33 can be also be removed when necessary to serve as a lighting source independent of base 20. A handle 32 is provided on the front of fluorescent/incandescent lamp 30 for ease of carrying. A drawer cavity 23 is formed in the side of base 20 for receiving a drawer 26 hingably attached to base 20 for storing small items. FIG. 3 shows in more detail the location of drawer 26 in the side of base 20.

Figure 4:
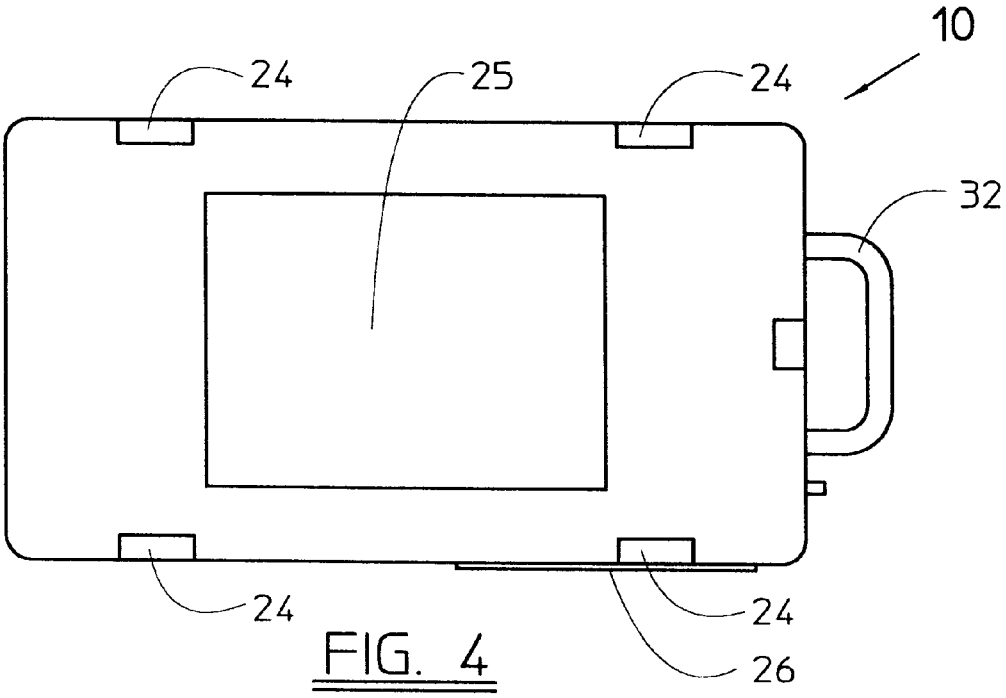
FIG. 4 is a top view of the base of FIG. 3.
Figure 5:
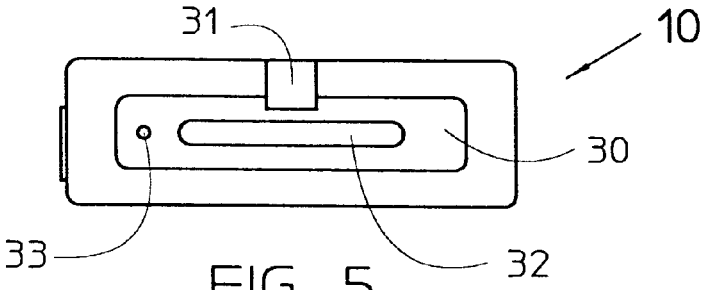
FIG. 5 is an end view of the base of an illuminated beverage container showing the detail of the installation of the fluorescent/incandescent light, according to the preferred embodiment of the present invention.

FIG. 4 shows the location and placement of lens 25 on the upper surface of base 20. Handle 32 can be seen extending from the side of base 20. Also can be seen are the strap receiving notches 24 located on the upper edge of base 20. FIG. 5 shows the placement of fluorescent/incandescent lamp 30 in cavity 21 formed in the end of base 20. On/off switch 33 is also seen on the front face of fluorescent/incandescent lamp 30.

Figure 6:
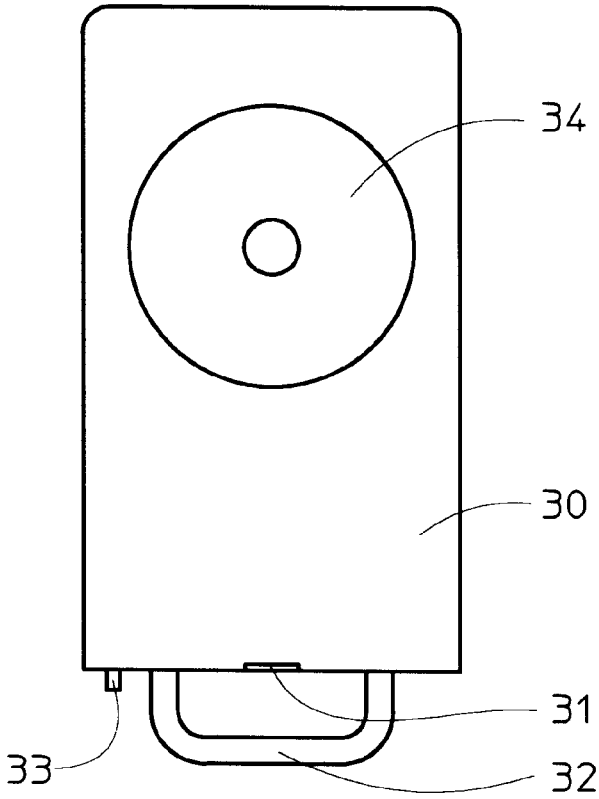
FIG. 6 is a top view of the fluorescent/incandescent light from an illuminated beverage container, according to the preferred embodiment of the present invention.
Figure 7:
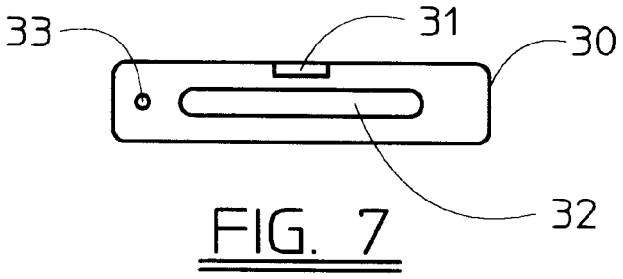
FIG. 7 is an end view of the fluorescent/incandescent light of FIG. 6.
Figure 8:
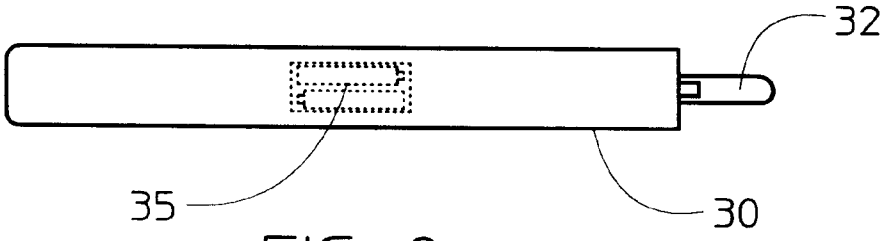
FIG. 8 is a side view of the fluorescent/incandescent light of FIGS. 6–7 showing the detail of the battery compartment, according to the preferred embodiment of the present invention.

FIGS. 6 through 8 show various views of fluorescent/incandescent lamp 30 including bulb 34 in FIG. 6 and battery compartment 35 in FIG. 8. It is envisioned that standard batteries commonly used in toys, flashlights, and small electronic devices would be sufficient to power lamp 34. A rechargeable battery and charger may also be employed.

2. Operation of the Preferred Embodiment

To use the present invention, one simply fills the beverage container with a beverage or installs a beverage container purchased pre-filled with a beverage. A pair of straps having special clamps which clamp to the base hold the beverage container tightly to the base. The device is then transported such as when camping and placed on any surface. An on/off switch on the front of the fluorescent light allows a light installed in a cavity in the base to be turned on or off as desired. The fluorescent/incandescent light shines up into the beverage container through a transparent lens lighting the beverage in the container. The fluorescent light can be removed from base to be used as an independent lighting source as desired. A special latch on the front of the fluorescent/incandescent light releases the fluorescent/incandescent light from the base. The fluorescent/incandescent light is powered by ordinary or rechargeable batteries.

As designed, a device embodying the teachings of the present invention is easily applied. The foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. An illuminated beverage container, comprising:

a container, said container being a rectangular shaped vessel, made from injection molded plastic, and having an interior volume of 2.5 gallons;

a base, said base being a rectangular shaped vessel having an interior volume, a first end and an opposite end, is made from injection molded plastic and adapted to receive said container;

a pouring spout, said pouring spout provided on said container to allow a user to dispense fluids from the container;

a lamp, said lamp removably installed in said base volume and pointed upward so that light from said lamp is directed up into said container volume; and an attachment means, said attachment means for securing said beverage container to said base, wherein said attachment means consists of a pair of nylon straps wherein a clamp at each end of each said strap is designed to be clamped to a strap receiving point formed in the upper edges of said base.

2. The illuminated beverage container of claim 1, wherein a rectangular aperture formed in an upper surface of said base allows light from said lamp to shine into a bottom of said container, and a transparent lens is permanently attached to cover said rectangular aperture to segregate said interior volume of said base from said bottom of said container yet allows light to pass through from said lamp to said container.

3. The illuminated beverage container of claim 2, wherein said lamp is inserted into a specially formed cavity in an end of said base and said lamp is secured to said base by a latch via a notch formed on said base.

4. The illuminated beverage container of claim 3, wherein an on/off switch on a front of said lamp allows the user to turn said lamp on and off as desired, and said lamp can be removed when necessary to serve as a lighting source independent of said base.

5. The illuminated beverage container of claim 4, wherein said lamp further consists of a handle for ease of carrying, a bulb, and a battery compartment, and wherein it is envisioned that standard batteries commonly used in toys, flashlights, and small electronic devices would power said lamp, or alternately, a rechargeable battery and charger may be employed.

6. The illuminated beverage container of claim 5, wherein a drawer cavity is formed in a side of said base for receiving a drawer hingably attached to said base for storing small items.

7. The illuminated beverage container of claim 6, wherein said lamp may be of the type selected from the group comprising fluoresecent or incandescent lamps.

8. The illuminated beverage container of claim 7, wherein the volume and dimensions chosen for said container match the 2.5 gallon disposable plastic containers wherein water and other beverages are commonly sold in grocery stores and the like, and wherein a provided 2.5 gallon container can be temporarily substituted for a disposable container from the grocery store.

* * * * *